US005642770A

United States Patent [19]

Imthurn et al.

[11] Patent Number: 5,642,770

[45] Date of Patent: Jul. 1, 1997

[54] NON-FERROUS METAL CASTING ROTATIONAL CONTROL APPARATUS

[75] Inventors: James A. Imthurn, Post Falls, Id.; Len J. Wiater; Graham T. Beaven, both of Spokane, Wash.

[73] Assignee: Wagstaff, Inc., Spokane, Wash.

[21] Appl. No.: 509,183

[22] Filed: Jul. 31, 1995

[51] Int. Cl.[6] ..... B22D 11/00; B22D 11/08; B22D 11/12

[52] U.S. Cl. ..... 164/420; 164/426; 164/441

[58] Field of Search ..... 164/322, 326, 164/47, 129, 271, DIG. 6, 420, 484, 445, 446, 426, 425, 441

[56] References Cited

U.S. PATENT DOCUMENTS 4,714,105 12/1987 Keutgen et al. ..... 164/420

4,766,945 8/1988 Sylvester ..... 164/136

5,339,885 8/1994 Sinden et al. ..... 164/450.4

*Primary Examiner*—Joseph J. Hail, III

*Assistant Examiner*—I.-H. Lin

*Attorney, Agent, or Firm*—Wells, St. John, Roberts, Gregory & Matkin, P.S.

[57] ABSTRACT

Disclosed is an apparatus for the prevention of unacceptable rotation control of a vertical non-ferrous metal casting apparatus during the casting process, and more particularly for aluminum. A guide key internal to the ram interacts with an inset keyway in the guide column to prevent the unacceptable rotation of the ram during casting.

16 Claims, 10 Drawing Sheets

50c
50
50a
50b

II
II
58
56
63

II
II
58
56
63

NON-FERROUS METAL CASTING ROTATIONAL CONTROL APPARATUS

TECHNICAL FIELD

The present invention relates to a non-ferrous metal casting rotational control apparatus to prevent the unacceptable rotation of the starting blocks of vertically oriented non-ferrous metal casting machines during the casting of non-ferrous metal ingots and billets.

BACKGROUND OF THE INVENTION

Non-ferrous metal ingots and billets are formed by casting in a vertically oriented mold, which is generally situated above a large casting pit beneath the floor level of the casting facility. The lower component of the vertical casting mold is a starting block mounted on starting block pedestals. When the casting process begins, the starting blocks are in their upward-most position and in the molds. As molten non-ferrous metal is poured into the mold and cooled, the starting block is slowly lowered at a pre-determined rate by a hydraulic cylinder. As the starting block is lowered, solidified non-ferrous metal or aluminum emerges from the bottom of the mold and ingots or billets are formed.

While the invention applies to casting and rotational control during the casting of non-ferrous metals, including aluminum, brass, lead, zinc, magnesium, copper etc., the examples given and preferred embodiment disclosed are for aluminum, and therefore the term aluminum will be used throughout for consistency even though the invention applies more generally to non-ferrous metals.

As shown in FIG. 1, the vertical casting of aluminum generally occurs beneath the elevation level of the factory floor in a casting pit. Directly beneath the casting pit floor 1*a* is a caisson 3, in which the hydraulic cylinder barrel 2 for the hydraulic cylinder is placed.

As shown in FIG. 1, the components of the lower portion of a typical vertical aluminum casting apparatus, shown within a casting pit 1 and a caisson 3, are a hydraulic cylinder barrel 2, a ram 6, a mounting base housing 5, a platen 7 and a starting block base 8, all shown at elevations below the casting facility floor 4.

Although the hydraulic cylinder barrel 2 is referred to as such in the industry and herein, for purposes of this invention, it is a vertically oriented elongated enclosure with a hollow interior and can be any shape or configuration. Further, while the term ram 6 is used herein to refer to the component so identified, it is also sometimes referred to as a piston or a piston rod, but for consistency herein will be referred to as a ram or hydraulic ram. The ram is a sliding component which moves back and forth against fluid pressure, as described more fully herein.

The mounting base housing 5 is mounted to the floor 1*a* of the casting pit 1, below which is the caisson 3. The caisson 3 is defined by its side walls 3*b* and its floor 3*a*.

A torque limiter 9 interconnects the platen 7 and the ram 6 to protect the ram 6 and related parts in the event of a severe rotational force, in which case the torque limiter 9 will cause the connection between the platen 7 and the ram 6 to release and allow the platen 7 to rotate without damaging the ram 6 or parts connected to the ram 6. A typical mold table assembly 10 is also shown in FIG. 1, which can be tilted as shown by hydraulic cylinder 11 pushing mold table tilt arm 10*a* such that it pivots about point 12 and thereby raises and rotates the main casting frame assembly, as shown in FIG. 1. There are also mold table carriages which allow the mold table assemblies to be moved from the position above the casting pit.

FIG. 1 further shows the platen 7 and starting block base 8 partially descended into the casting pit 1 with billet 13 being partially formed. Billet 13 is on starting block 14, which is mounted on pedestal 15. While the term starting block is used for item 14, it should be noted that the terms bottom block and starting head are also used in the industry to refer to item 14, bottom block typically used when an ingot is being cast and starting head when a billet is being cast.

While the starting block base 8 in FIG. 1 only shows one starting block 14 and pedestal 15, there are typically several of each mounted on each starting block base, which simultaneously cast billets or ingots as the starting block is lowered during the casting process.

The upper portion of the aluminum casting apparatus includes a vertical aluminum mold table assembly 10 and tilts to the upward position shown in FIG. 1.

When hydraulic fluid is introduced into the hydraulic cylinder at sufficient pressure, the ram 6, and consequently the starting block base 8, are raised to the desired elevation start level for the casting process, which is when the starting blocks are within the mold table assembly 10.

The lowering of the starting block base 8 is accomplished by metering the hydraulic fluid from the cylinder at a pre-determined rate, thereby lowering the ram 6 and consequently the starting blocks at a pre-determined and controlled rate. The mold is controllably cooled during the process to assist in the solidification of the emerging ingots or billets, typically using water cooling means.

It is critical to the resulting quality of the finished aluminum ingots or billets to maintain true vertical movement without unacceptable rotation of the starting block during the casting process. Very slight rotation of the starting block while it is being lowered during the casting process can result in significant imperfections in the ingots and billets and rejection of the several ingots and billets being simultaneously cast in that particular casting batch.

Prior art generally provides rotational guidance systems of two types, internal and external.

In the external guidance systems, the platen is guided by vertical guide rails which are mounted to the side walls of the casting pit. The platen in these external systems has mating shoes which slide along the guide rails while the starting block base is lowered, thereby restricting the rotation of the platen during casting.

While these external rotational guidance systems can maintain low tolerances, the vertical guide rails and mating shoes are exposed to the harsh environment of an aluminum casting facility. This results in the buildup of dirt, debris and molten metal from aluminum spills on both the guide rails and the mating shoes. When buildup occurs, it not only affects the rotational stability, but can also result in the stoppage of the vertical movement of the starting block base, which freezes the billet or ingot in the mold in the middle of a cast and is very time consuming and difficult to remedy.

Internal rotational guidance systems are intended to prevent the unacceptable rotation of the starting block base while also avoiding the problems associated with external systems due to the environmental and operating conditions.

One form of an internal system is shown in FIG. 2, which illustrates a hydraulic cylinder barrel 2, a ram 6, barrel flange 19 and mounting base housing 5. The internal guide rail 20 is welded along the entire vertical length of the interior wall of the hollow hydraulic cylinder barrel 2. A guide 31 is mounted on and extends outwardly from the ram and mates with a guide rail 20 on the interior wall of the hydraulic cylinder barrel 2. As the ram 6 is raised, the guide 31 slides along the guide rail 20 to maintain the ram 6 in fixed rotational alignment.

FIG. 3 shows a cross-section from FIG. 2, illustrating the guide 31 with guide rail interfaces 34 defining an aperture which corresponds to the guide rail 20 shown in FIG. 2.

In order to meet the requisite accuracies for aluminum castings, the welding of the guide rail 20 along the entire length of the interior of the hydraulic cylinder barrel 2 requires substantial time and expense. Furthermore, utilizing such a guidance system with a key external to the ram 6 and internal to the hydraulic cylinder barrel 2, requires that the diameter of the hydraulic cylinder barrel 2 and consequently of the caisson, be unnecessarily large.

The size of the caissons 3 for existing external rotational guidance systems is smaller than for the internal rotational guidance system because the additional size of the mating guide does not have to be accommodated. The numerous aluminum casting pits yet to be converted from an external rotational guidance system to an internal rotational guidance system will require substantial excavation of the factory floor to make the existing pits and caissons larger to convert or upgrade to the larger diameter internal guidance systems. Making modifications to casting pits and caissons within existing factories is undesirable due to the expense and disruption.

FIG. 4 illustrates a cross-section of another attempt to maintain internal rotational control during the aluminum casting process. Figure 4 shows a hydraulic cylinder barrel 40, a ram 41 and a guide 42. The guide 42 is attached to the bottom of the ram 41 in similar fashion to the guide 31 illustrated in FIG. 2.

As shown in FIG. 4, a square or rectangular aperture 44 is defined within the longitudinal center of the ram 6. Located within the aperture 44 is a corresponding center guide key 43. When the ram moves vertically, the corresponding surfaces of the aperture 44 and the center guide key 43 are intended to prevent the rotation of the starting block base during the casting process.

While the internal rotational control system shown in FIG. 4 has the advantage of a smaller hydraulic cylinder barrel and is adaptable to existing smaller diameter caissons, it is unable to achieve the tolerances demanded in the industry because the contact surfaces are too near the center of rotation, thus having very little rotational control.

The need for an internal rotational guidance system which can be utilized in existing casting pits and caissons and which can meet the tolerance requirements of the aluminum industry has been recognized, but has not been adequately fulfilled by prior known machinery or methods.

A further need has been recognized for such a rotational stabilization system that can easily be installed within existing casting pits and caissons, without the need for substantial modification to accommodate the larger diameter hydraulic cylinder barrel required by internal systems which utilize a guide external to the ram and internal to the hydraulic cylinder barrel.

A still further need has been recognized for an environmentally protected rotational stabilization system which does not require the substantial time and expense in welding a guide key along the entire vertical length of the interior of the hydraulic cylinder barrel, such as is required by the internal systems which utilize a mating guide external to the ram and internal to the hydraulic cylinder barrel.

The forenamed recognized needs have not heretofore been sufficiently fulfilled by existing rotational control and guide systems.

The present invention is an internal rotational guidance system for vertical aluminum casting machines which meets or exceeds the desired tolerance levels of the aluminum casting industry and which accomplishes this within a much smaller cross-sectional area, thus having the further advantage of being easily installed in existing casting pits and caissons which cannot accommodate the larger diameter barrel tubes without substantial modification thereto.

BRIEF DESCRIPTION OF THE DRAWINGS

Preferred embodiments of the invention are described below with reference to the accompanying drawings, which are briefly described below.

FIG. 9 is an elevation cross-section of the barrel;

FIG. 10 is an elevation of the guide column;

FIG. 16 is an elevation cross-section of a guide column of another embodiment showing the guide keyrail integrated into the guide column.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Many of the fastening, connection, process and other means and components utilized in this invention are widely known and used in the field of the invention described, and their exact nature or type is not necessary for an understanding and use of the invention by a person skilled in the art or science, and they will not therefore be discussed in significant detail. Furthermore, the various components shown or described herein for any specific application of this invention can be varied or altered as anticipated by this invention and the practice of a specific application of any element may already be widely known or used in the art or by persons skilled in the art or science and each will not therefore be discussed in significant detail.

Figure 1:
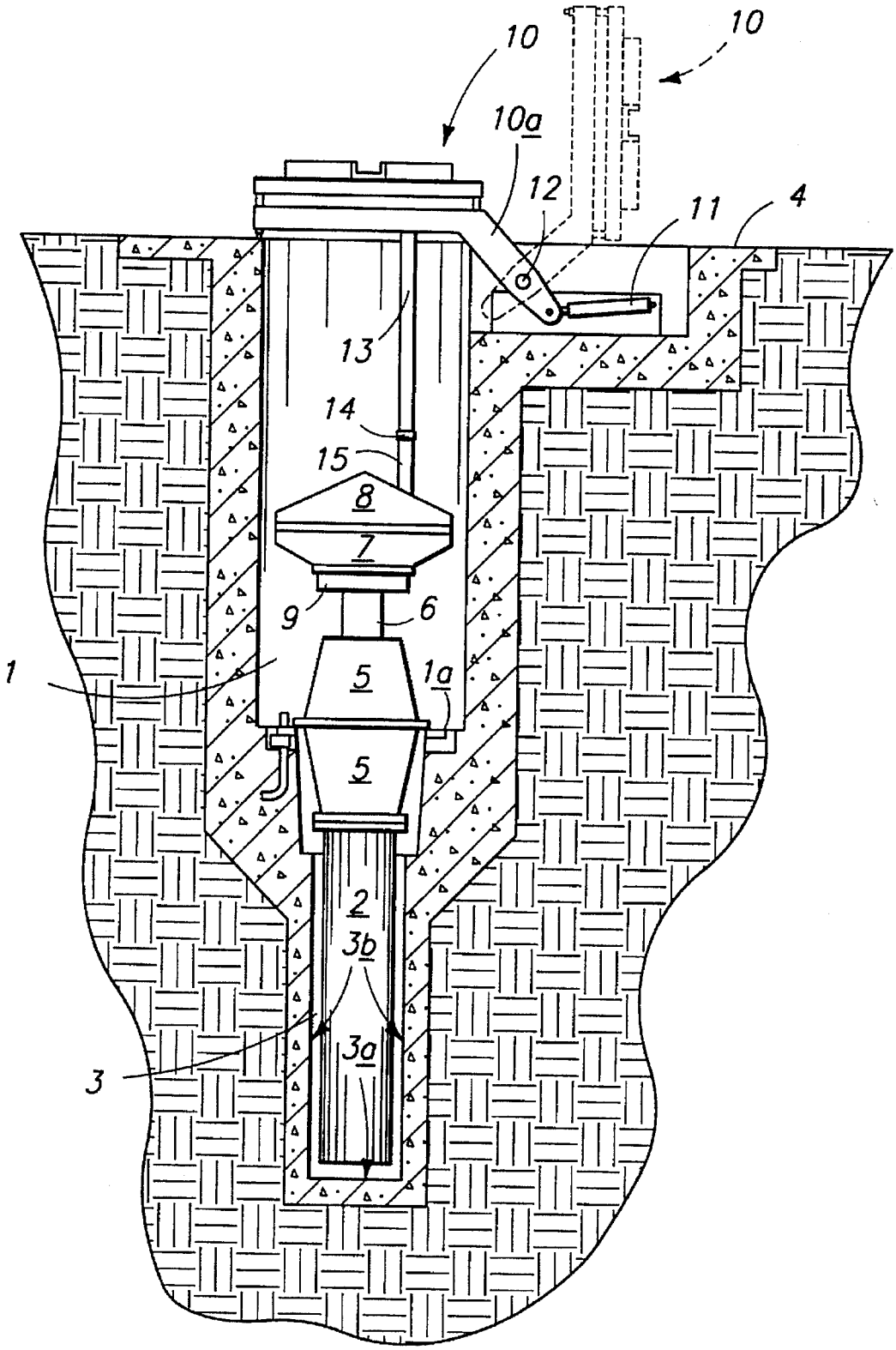
FIG. 1 is an elevation view of a typical casting pit, caisson and aluminum casting apparatus.
Figure 2:
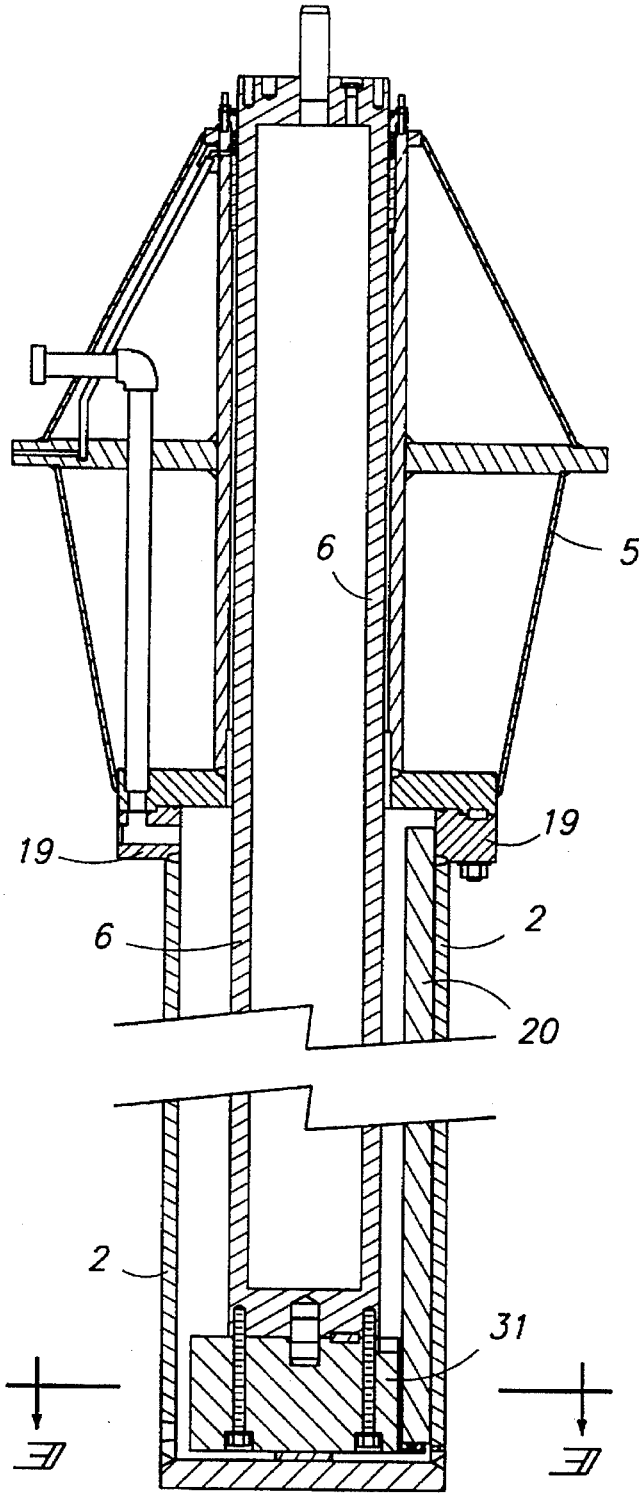
FIG 2 PRIOR ART
FIG. 2 is a vertical cross-section view of an internal prior art rotational guidance system utilizing a guide external to the ram but internal to the hydraulic cylinder barrel.
Figure 3:
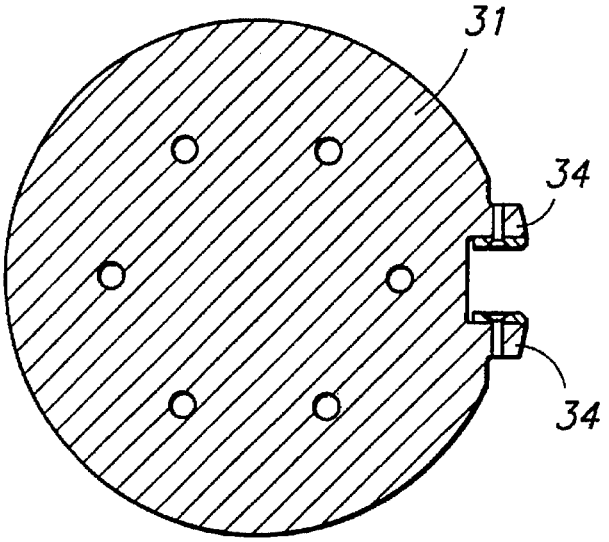
FIG 3 PRIOR ART
FIG. 3 is a cross-section view of an internal prior art rotational guidance system utilizing a guide external to the ram but internal to the hydraulic cylinder barrel.
Figure 4:
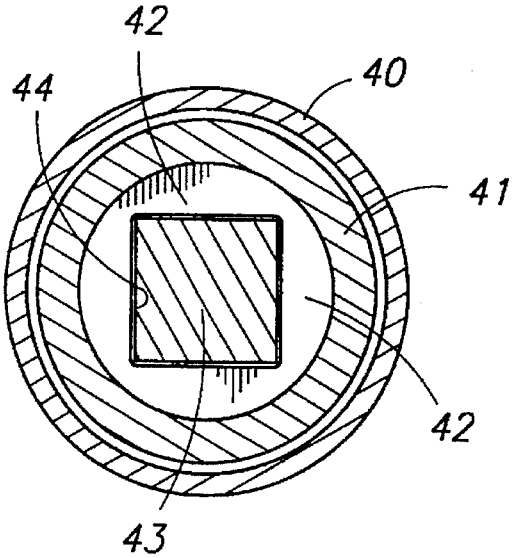
FIG 4 PRIOR ART
FIG. 4 is a cross-section view of an internal prior art rotational guidance system utilizing a square guide column at the center of the ram.
Figure 13:
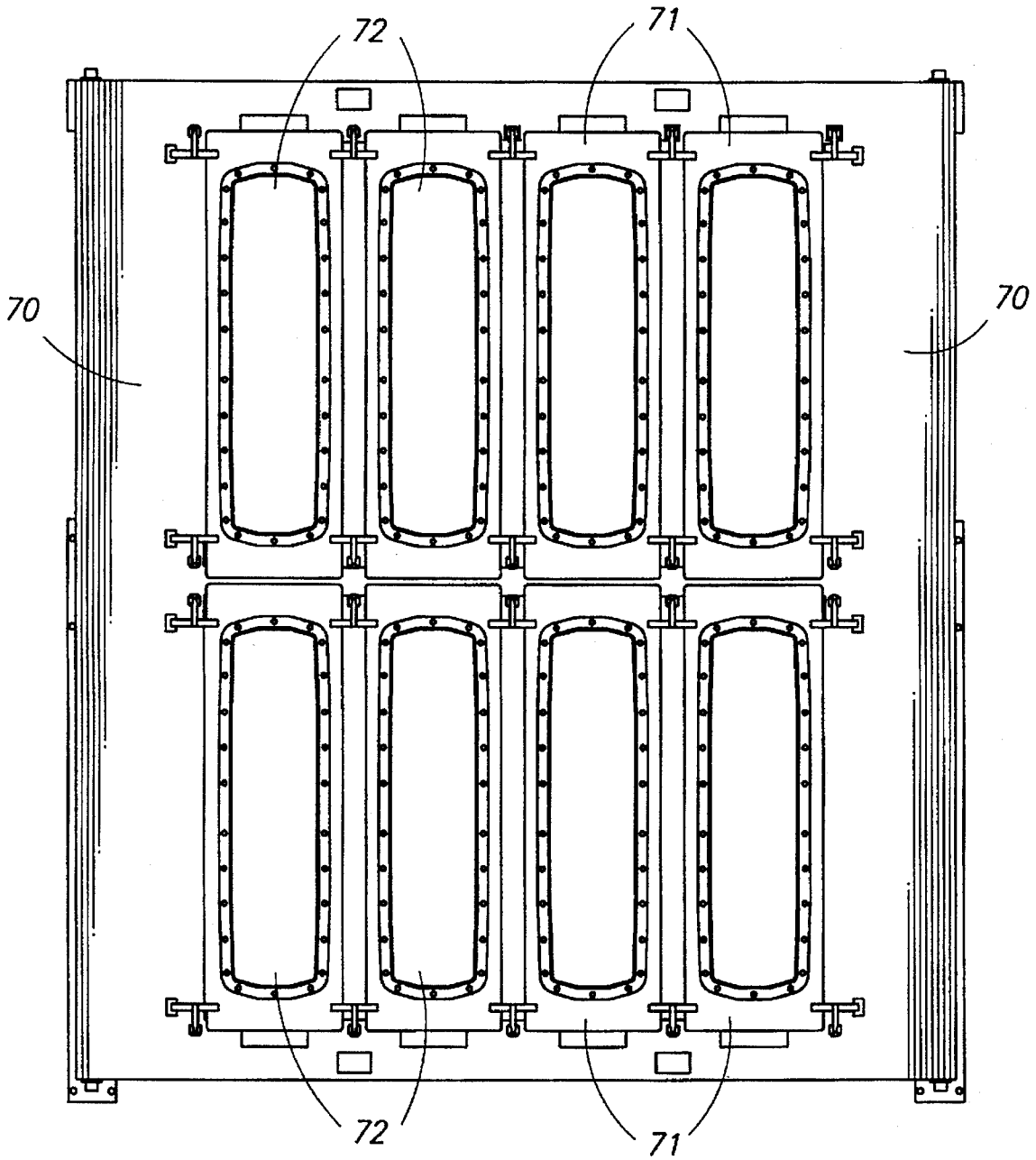
FIG. 13 is a top view of a vertical casting frame assembly.

A typical mold table assembly 10 which can be used in combination with the invention is shown in FIGS. 1 and 13 and is generally known in the aluminum industry.

Figure 5:
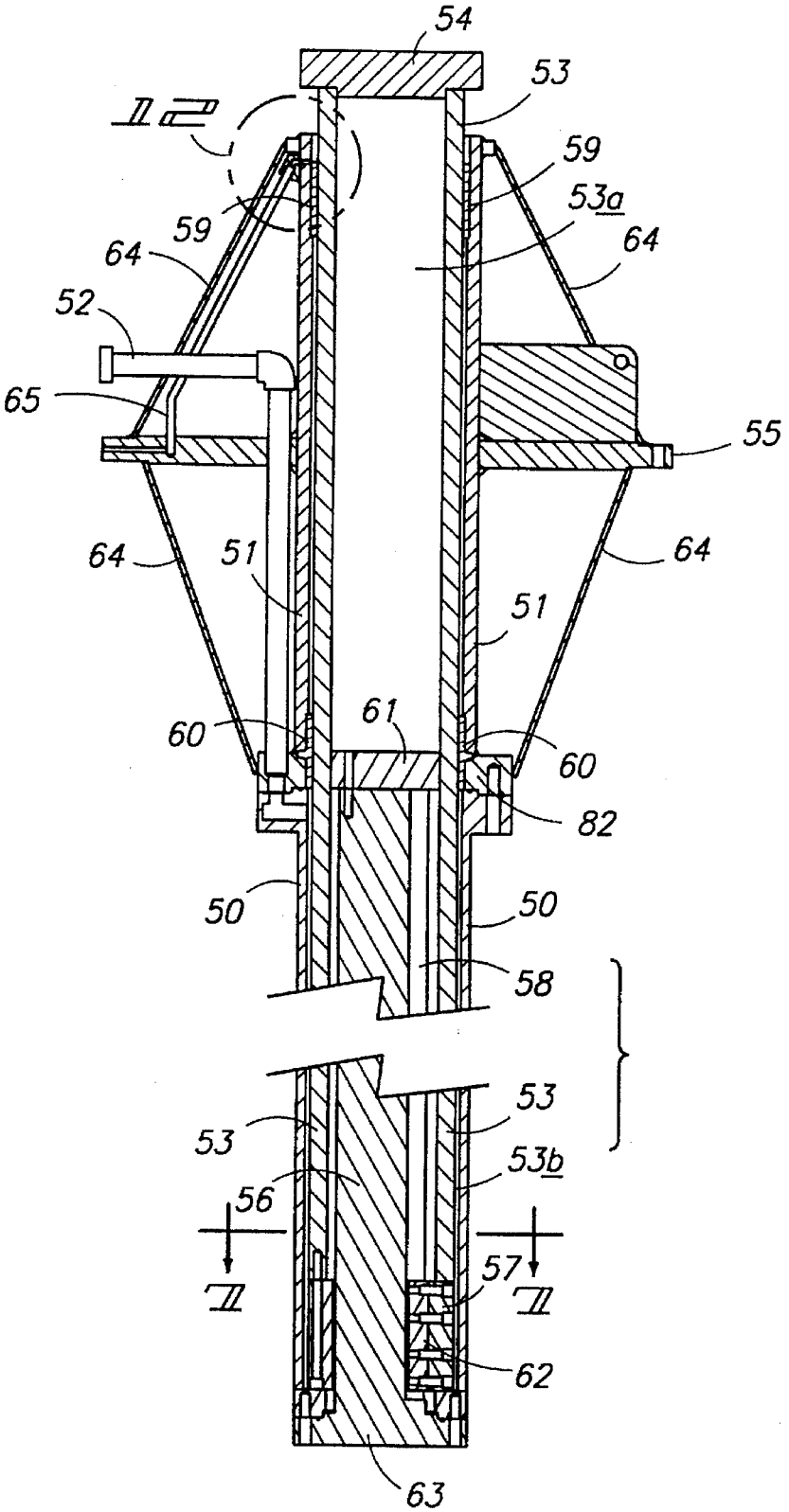
FIG. 5 is a cross-sectional view of a rotational guidance apparatus disclosed by the invention.

FIG. 5 shows a cross-section view of the invention, including an enclosure or hydraulic cylinder barrel 50 of smaller diameter, a rigid framework which in FIG. 5 includes vertical housing supports 51, also referred to as cylinder base tube, and housing 64, also referred to as cylinder base, mounted to the casting facility floor by mounting base 55. The ram 53 with ram endcap 54, slides about guide column 56 while guide column endcap 61 acts as a stop for ram 53.

Ram 53 moves through vertical housing supports 51 guided by lower bearing 60 and upper bearing 59.

FIG. 5 further shows the hydraulic fluid feed 52 and air bleed line 65. To raise the ram 53 to the position to begin casting the ingots or billets, hydraulic fluid is fed into the inner cavity 53*a* and outer cavity 53*b* of the ram 53 under pressure. When the pressure from the hydraulic fluid exceeds the force required to lift the ram 53, the ram 53 is raised to the position where casting can begin.

As the casting process continues, the molten aluminum is cooled in the mold and the hydraulic fluid in the inner cavity 53*a* of the ram 53 is controllably metered out by a flow control valve through hydraulic piping 52 to lower the ram at the desired rate. There is an air bleed line 65 shown in FIG. 5 through which air may be periodically bled.

Figure 6:
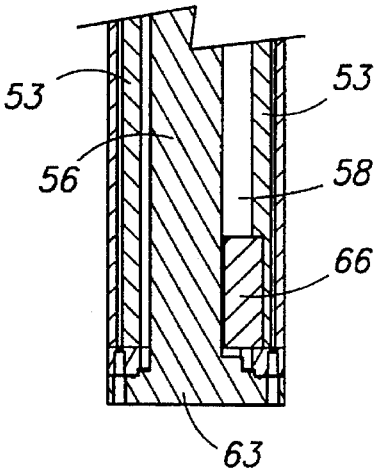
FIG. 6 is an elevation cross-section view of the invention.

FIG. 5 illustrates the keyway 58 longitudinally inset into the guide column 56, and the guide key 62 attached to guide 57. Guide 57 is attached to the lower end of ram 53. While FIG. 5 illustrates the use of a separate guide 57 attached to the lower end of the ram 53, FIG. 6 illustrates an advantageous alternative, which is to attach a key 66 to the interior wall of ram 53, the key 66 corresponding to keyway 58 and which controls the rotation of the ram 53 with respect to the guide column 56. As shown in FIG. 6, the bottom endcap flange 63 on guide column 56 is a stop mechanism for the downward-most position of the ram 53.

Figure 7:
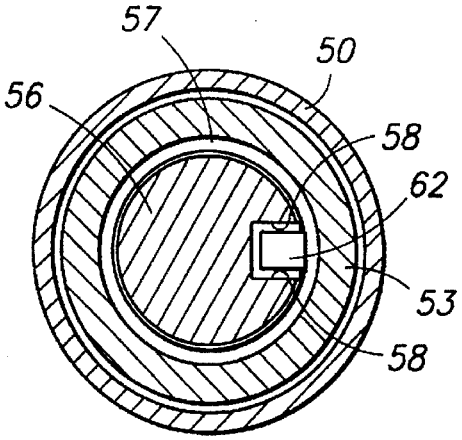
FIG. 7 is cross-section view (7—7) from FIG. 5, of the ram, guide column and guide column keyway.

FIG. 7 is the 7—7 cross-section from FIG. 5 and illustrates the hydraulic cylinder barrel 50, the ram 53, the guide 57, the guide column 56 and the key 62 within keyway 58. Key 62 has bronze shoes attached to its three faces to act as bearing surfaces.

Figure 8:
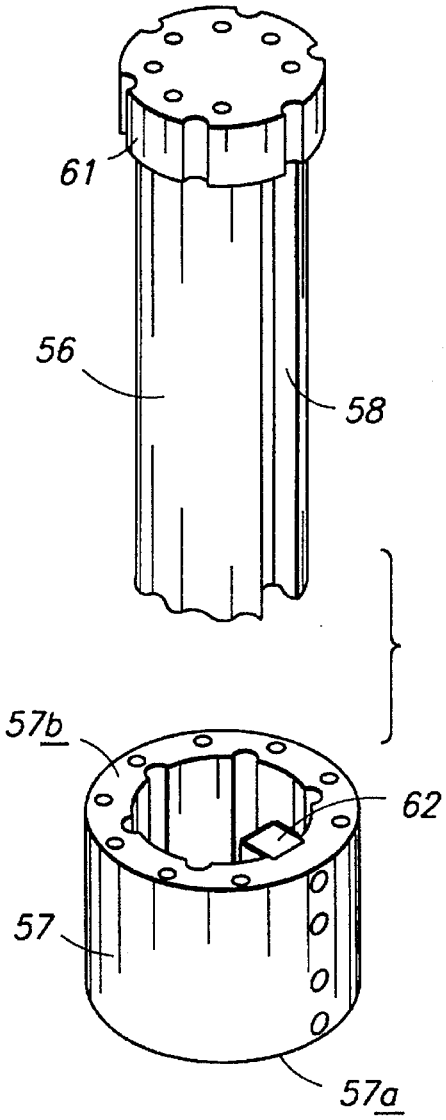
FIG. 8 is a perspective of the guide apart from the guide column.

FIG. 8 is a perspective fragmented view of guide 57 relative to guide column 56. The key 62 is attached to the internal wall of the guide 57 and interacts with the keyway 58 inset in guide column 56. The upper end 57*b* of guide 57 is attached to the lower end of ram 53.

FIG. 9 shows a cross-section of the cylinder barrel 50, its inner cavity 50*a*, its downward end 50*b* and upward end 50*c*. The lower end 50*b* attaches to flange 63 on guide column 56, thereby securing guide column 56 to cylinder barrel 50. Upward end 50*c* of cylinder barrel 50 is attached to mount base 82.

Figure 11:
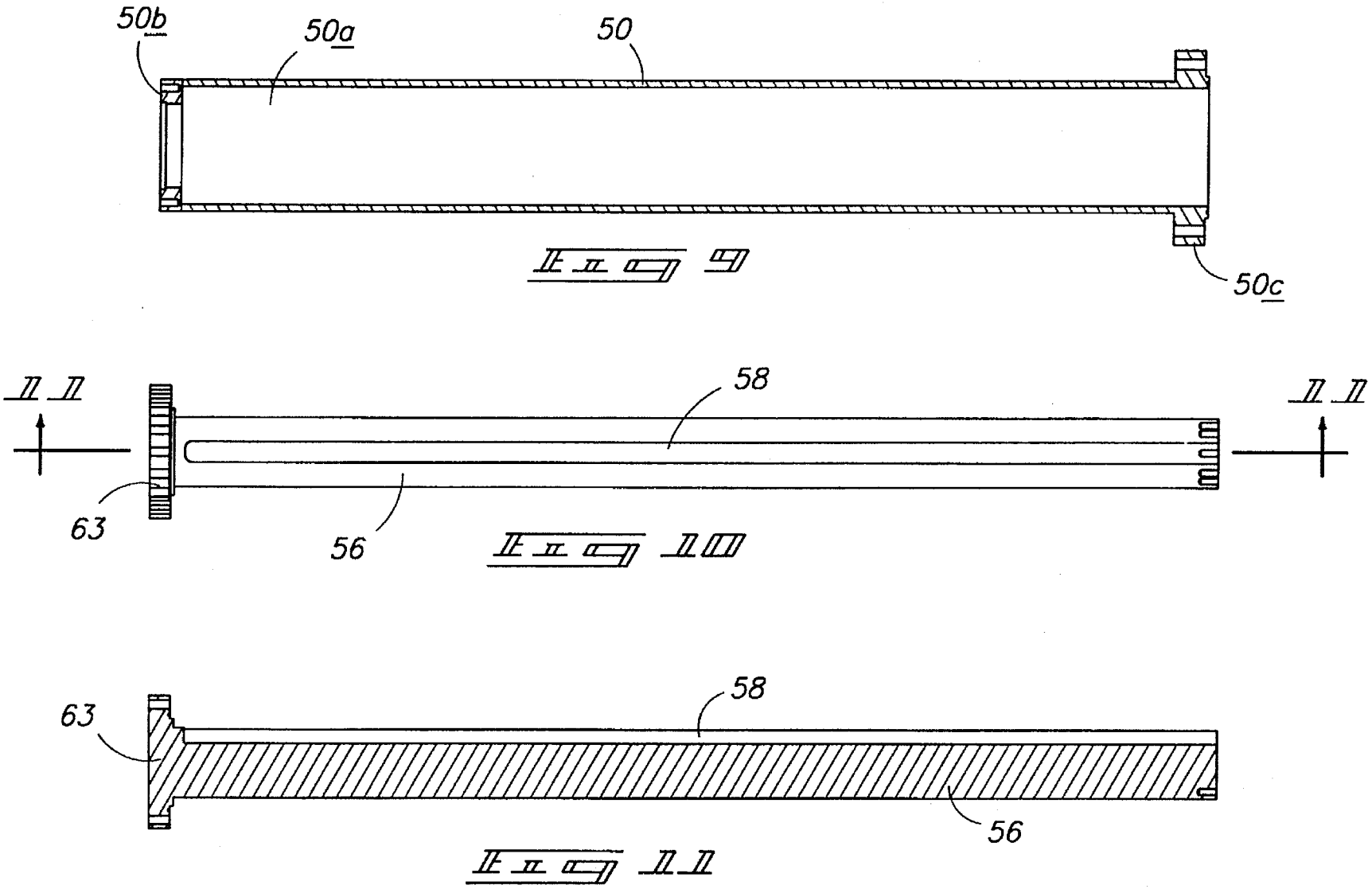
FIG. 11 is an elevation cross-section of the guide column showing the guide column key-way.

FIG. 10 illustrates the guide column 56 with the keyway 58 inset therein along its longitudinal length, and FIG. 11 illustrates the guide column rotated ninety degrees from FIG. 10. The guide column 56 is shown with keyway 58 inset therein and bottom endcap flange 63.

Figure 12:
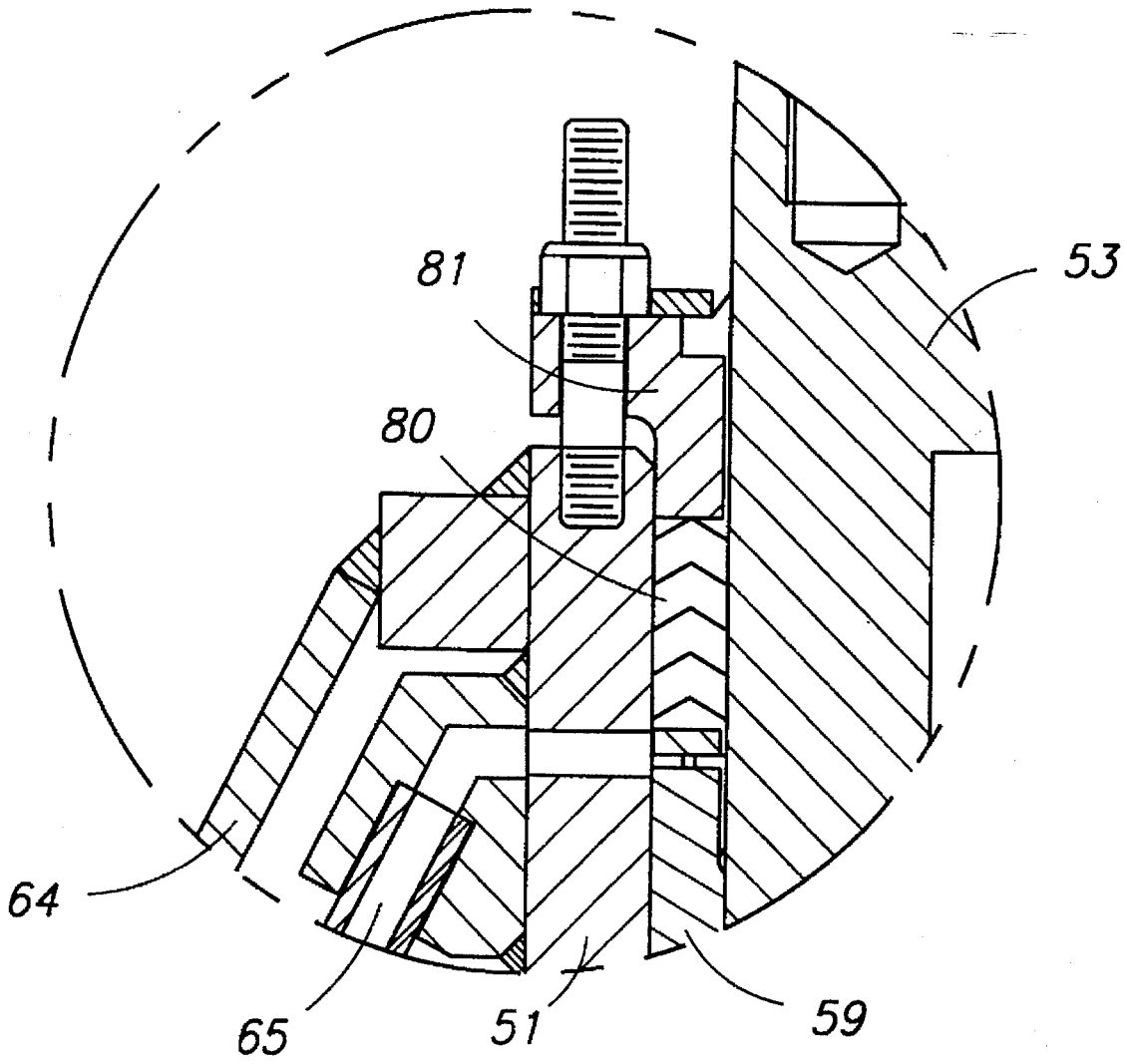
FIG. 12 is an enlarged view from FIG. 5 of the sealed connection between the ram and the housing.

FIG. 12 is an enlarged view from FIG. 5 of the sealed connection between the ram and the housing, including ram 53, upper bearing 59, vertical housing supports 51, seal packing 80, packing retainer ring 81, air bleed line 65 and housing 64.

FIG. 13 shows a top view of a known aluminum mold table assembly, shown in FIG. 1 as item 10, including a casting framework 70, casting molds 71 and casting apertures 72 in the casting molds 71.

There is another embodiment of the invention wherein the key or keyrail is attached to or integrated with the guide column, with a corresponding mating guide attached to the inside surface wall of the ram or with a corresponding inset keyway in the ram. This embodiment is illustrated in FIGS. 14 through 16.

Figure 14:
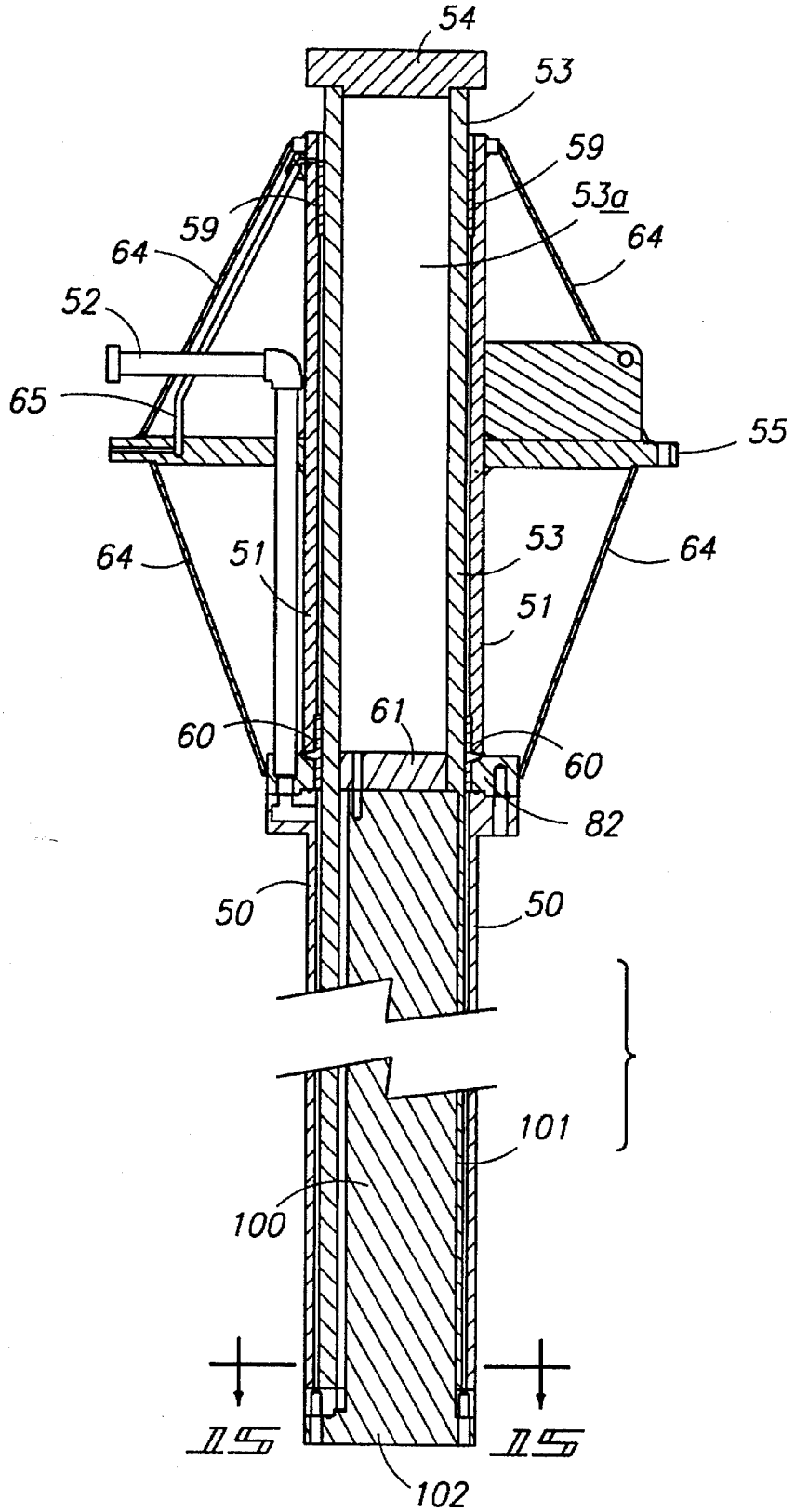
FIG. 14 is a cross-sectional view of another embodiment of the rotational guidance apparatus disclosed by the invention, with the guide keyrail integrated with the guide column.
Figure 11:
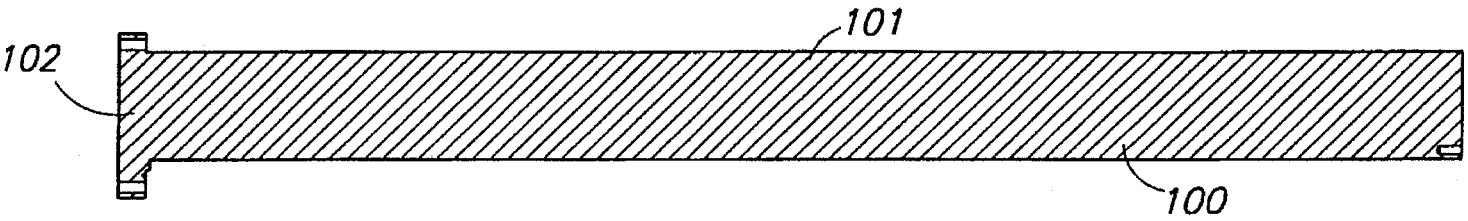

FIG. 14 shows a cross-sectional view of another embodiment of the rotational guidance apparatus disclosed by the invention, wherein the guide keyrail is attached to or integrated with the guide column 100. The cross-section of the guide column 100 includes the keyrail 101 portion, which extends into a mating keyway inset in the inner wall surface of the ram 53.

The keyway inset in the inner wall surface of the ram is preferrably accomplished by utilizing a guide as shown as item 57 in FIG. 5, and which is attached to the lower or bottom end of the ram 53. In such a case, the guide would have the same cross-section as shown for the ram 53 in FIG. 14, only the guide column would need to be smaller in diameter to accomodate the keyrail on the guide column within the confines of the same inner diameter hydraulic cylinder barrel.

Figure 15:
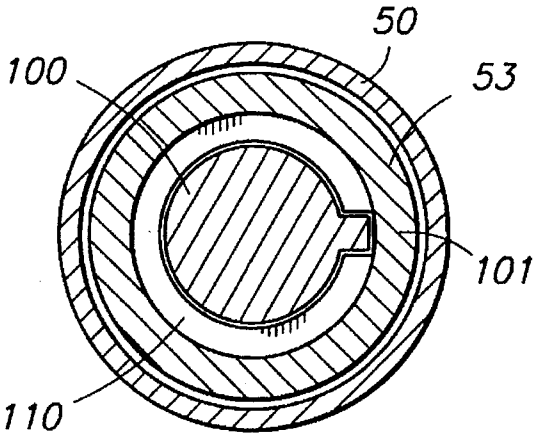
FIG. 15 is the 15—15 cross-section from FIG. 14.

FIG. 15 is the 15—15 cross-section from FIG. 14 and illustrates the interaction and fit between the attached or integrated guide column 100 and keyrail 101 relative to the inset keyway in the inner wall surface of the ram 53. The guide 110 is attached to the bottom of ram 53 and corresponds to the size and shape of the guide column 100 and keyrail 101.

FIG. 16 is an elevation cross-section of a guide column of another embodiment showing the attached or integrated guide column 100, keyrail 101 and bottom endcap flange 102.

Aluminum is typically poured into the vertical casting molds by molten metal distribution launders, such as is set forth in U.S. Pat. No. 5,316,071, entitled "Molten Metal Distribution Launder", which is incorporated herein by this reference.

During the casting process and for control purposes in vertical aluminum casting assemblies, molten metal level sensors and controllers are typically used to control and monitor the casting process, an example of which is set forth in U.S. Pat. No. 5,339,885, which is incorporated herein by this reference.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An internal rotational guidance apparatus for use in combination with a vertical non-ferrous metal mold table assembly, comprising:

a. a vertically oriented elongated enclosure with a hollow interior;

b. an elongated guide column within the enclosure, the guide column including a longitudinally inset keyway in an exterior surface of the guide column;

c. an elongated ram with a hollow interior and which is inserted downward into the hollow interior of the enclosure and over the exterior surface of the guide column;

d. a key attached to an interior surface of the ram and corresponding in cross-sectional size and shape to the inset keyway in the guide column, the key positioned such that when the ram slides with respect to the guide column, the key slides within the inset keyway; and e. a hydraulic feed and bleed assembly to provide pressure control to raise and lower the ram.

2. An internal rotational guidance apparatus for use in combination with a vertical non-ferrous metal mold table assembly, as recited in claim 1, wherein the enclosure, the guide column and ram are coaxial.

3. An internal rotational guidance apparatus for use in combination with a vertical non-ferrous metal mold table assembly, as recited in claim 1, wherein the enclosure and the guide column are stationary.

4. An internal rotational guidance apparatus for use in combination with a vertical non-ferrous metal mold table assembly, as recited in claim 1, and in which the non-ferrous metal is aluminum.

5. An internal rotational guidance apparatus for use in combination with a vertical non-ferrous metal mold table assembly, comprising:

a. a vertically oriented elongated enclosure with a hollow interior;

b. an elongated guide column within the enclosure, the guide column including a longitudinally inset keyway in an exterior surface of the guide column;

c. an elongated ram with a hollow interior and which is inserted downward into the hollow interior of the enclosure and over the exterior surface of the guide column; and d. a guide with a hollow interior which slides over the external surface of the guide column, the guide being attached to a lower end of the ram;

e. a guide key attached to an interior surface of the guide and corresponding in cross-sectional size and shape to the inset keyway, the guide key positioned such that when the ram and guide slide with respect to the guide column, the guide key slides within the inset keyway in the guide column; and f. a hydraulic feed and bleed assembly to provide pressure control to raise and lower the ram.

6. An internal rotational guidance apparatus for use in combination with a vertical non-ferrous metal mold table assembly, comprising:

a. a vertically oriented, hollow elongated cylindrical enclosure;

b. an elongated cylindrical guide column within the enclosure, the guide column including a longitudinally inset keyway in an exterior surface of the guide column;

c. an elongated hollow cylindrical ram which is inserted downward into the interior of the enclosure and over the exterior surface of the guide column;

d. a key attached to an interior surface of the ram and corresponding in cross-sectional size and shape to the inset keyway in the guide column, the key positioned such that when the ram slides with respect to the guide column, the key slides within the inset keyway; and e. a hydraulic feed and bleed assembly to provide pressure control to raise and lower the ram.

7. An internal rotational guidance apparatus for use in combination with a vertical non-ferrous metal mold table assembly, as recited in claim 6, wherein the enclosure, the guide column and the ram are coaxial.

8. An internal rotational guidance apparatus for use in combination with a vertical non-ferrous metal mold table assembly, as recited in claim 6, wherein the enclosure and the guide column are stationary.

9. An internal rotational guidance apparatus for use in combination with a vertical non-ferrous metal mold table assembly, as recited in claim 6, and in which the non-ferrous metal is aluminum.

10. An internal rotational guidance apparatus for use in combination with a vertical non-ferrous metal mold table assembly, comprising:

a. a vertically oriented, hollow elongated cylindrical enclosure;

b. an elongated cylindrical guide column within the enclosure, the guide column including a longitudinally inset keyway in an exterior surface of the guide column;

c. an elongated hollow cylindrical ram which is inserted downward into the interior of the enclosure and over the exterior surface of the guide column;

d. a hollow cylindrical guide which slides over the external surface of the guide column, the guide being attached to a lower end of the ram;

e. a guide key attached to an interior surface of the guide and corresponding in cross-sectional size and shape to the inset keyway, the guide key positioned such that when the ram and guide slide with respect to the guide column, the guide key slides within the inset keyway in the guide column; and f. a hydraulic feed and bleed assembly to provide pressure control to raise and lower the ram.

11. A non-ferrous metal casting machine with an internal rotational guidance apparatus, comprising:

a. a vertical non-ferrous metal mold table assembly, including a plurality of casting molds and a casting frame;

b. a starting block base, including a plurality of starting block pedestals which correspond to the casting apertures in the casting frame;

c. a platen attached to the starting block base;

d. a vertically oriented elongated enclosure with a hollow interior;

e. an elongated guide column within the enclosure, the guide column including a longitudinally inset keyway into an exterior surface of the guide column, positioned within the enclosure;

f. an elongated ram with a hollow interior, attached at its upper end to the platen and which is inserted downward into the hollow interior of the enclosure and over the exterior surface of the guide column;

g. a key attached to an interior surface of the ram and corresponding in cross-sectional size and shape to the inset keyway, the key positioned such that when the ram slides with respect to the guide column, the key slides within the inset keyway in the guide column; and h. a hydraulic feed and bleed assembly to provide pressure control to raise and lower the ram.

12. A non-ferrous metal casting machine with an internal rotational guidance apparatus, as recited in claim 11, and in which the non-ferrous metal is aluminum.

13. A non-ferrous metal casting machine with an internal rotational guidance apparatus, comprising:

g. a vertical non-ferrous metal mold table assembly, including a plurality of casting molds and a casting frame;

h. a starting block base, including a plurality of starting block pedestals which correspond to the casting apertures in the casting frame;

i. a platen attached to the starting block base;

j. a vertically oriented elongated enclosure with a hollow interior;

k. an elongated guide column within the enclosure, the guide column including a longitudinally inset keyway into an exterior surface of the guide column, positioned within the enclosure;

l. an elongated ram with a hollow interior, attached at its upper end to the platen and which is inserted downward into the hollow interior of the enclosure and over the exterior surface of the guide column;

m. a guide with a hollow interior which slides over the external surface of the guide column, the guide being attached to a lower end of the ram;

n. a guide key attached to an interior surface of the guide and corresponding in cross-sectional size and shape to the inset keyway, the guide key positioned such that when the ram and guide slide with respect to the guide column, the guide key slides within the inset keyway in the guide column; and o. a hydraulic feed and bleed assembly to provide pressure control to raise and lower the ram.

14. An internal rotational guidance apparatus for use in combination with a vertical non-ferrous metal mold table assembly, comprising:

a. a vertically oriented elongated enclosure with a hollow interior;

b. an elongated guide column within the enclosure, the guide column including a longitudinally mounted keyrail on an exterior surface of the guide column;

c. an elongated ram with a hollow interior and which is inserted downward into the hollow interior of the enclosure and over the exterior surface of the guide column;

d. a keyway inset in an interior surface of the ram and corresponding in cross-sectional size and shape to the keyrail on the guide column, the keyway positioned such that when the ram slides with respect to the guide column, the keyrail slides within the inset keyway; and e. a hydraulic feed and bleed assembly to provide pressure control to raise and lower the ram.

15. An internal rotation guidance apparatus for use in combination with a vertical non-ferrous metal mold table assembly, comprising:

a. a vertically oriented elongated enclosure with a hallow interior:

b. an elongated guide column within the enclosure, the guide column including a longitudinally mounted keyrail on an exterior surface of the guide column;

c. an elongated ram with a hollow interior and which is inserted downward into the hollow interior of the enclosure and over the exterior surface of the guide column;

d. a guide with a hollow interior which slides over the external surface of the guide column, the guide being attached to a lower end of the ram;

e. an inset keyway in an interior surface of the guide, the keyway corresponding in cross-sectional size and shape to the keyrail on the exterior surface of the guide column, the inset keyway positioned such that when the ram and guide slide with respect to the guide column, the inset keyway slides over the keyrail on the guide column; and f. a hydraulic feed and bleed assembly to provide pressure control to raise and lower the ram.

16. A non-ferrous metal casting machine with an internal rotational guidance apparatus, comprising:

a. a vertical non-ferrous metal mold table assembly, including a plurality of casting molds and a casting frame;

b. a starting block base, including a plurality of starting block pedestals which correspond to the casting apertures in the casting frame;

c. a platen attached to the starting block base;

d. a vertically oriented elongated enclosure with a hollow interior;

e. an elongated guide column within the enclosure, the guide column including a longitudinally mounted keyrail on an exterior surface of the guide column;

f. an elongated ram with a hollow interior and which is inserted downward into the hollow interior of the enclosure and over the exterior surface of the guide column;

g. a guide with a hollow interior which slides over the external surface of the guide column, the guide being attached to a lower end of the ram;

h. an inset keyway in an interior surface of the guide, the keyway corresponding in cross-sectional size and shape to the keyrail on the exterior surface of the guide column, the inset keyway positioned such that when the ram and guide slide with respect to the guide column, the inset keyway slides over the keyrail on the guide column; and i. a hydraulic feed and bleed assembly to provide pressure control to raise and lower the ram.

* * * * *